US006415613B1

(12) United States Patent
Ackermann et al.

(10) Patent No.: US 6,415,613 B1
(45) Date of Patent: Jul. 9, 2002

(54) CRYOGENIC COOLING SYSTEM WITH COOLDOWN AND NORMAL MODES OF OPERATION

(75) Inventors: Robert Adolph Ackermann, Schenectady; Evangelos Trifon Laskaris, Niskayuna; Yu Wang, Clifton Park; Brian Ernest Baxter Gott, Delanson, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/681,310

(22) Filed: Mar. 16, 2001

(51) Int. Cl.[7] ..... F25B 19/00; F25B 7/06
(52) U.S. Cl. ..... 62/51.1; 62/259.2; 62/79
(58) Field of Search ..... 62/51.1, 259.1, 62/335, 79

(56) References Cited

U.S. PATENT DOCUMENTS 5,201,184 A * 4/1993 Roth ..... 62/47.1
5,317,878 A * 6/1994 Bradshaw et al. ..... 62/6
5,382,797 A * 1/1995 Kunimoto et al. ..... 250/352
5,513,498 A 5/1996 Ackermann et al.
5,861,574 A * 1/1999 Kotani et al. ..... 174/15.4

FOREIGN PATENT DOCUMENTS

JP 10-311618 11/1998

* cited by examiner

*Primary Examiner*—William Doerrler
(74) *Attorney, Agent, or Firm*—Jill M. Breedlove; Chrisstian G. Cabou

(57) ABSTRACT

A cryogenic cooling system for use with a superconductive electric machine includes a first set of components arranged in a first circuit and adapted to force flow of a cryogen in the first circuit to and from a superconductive electric machine and being operable in a cooldown mode for cooling the cryogen and thereby the superconductive electric machine to a normal operating temperature, and a second set of components arranged in a second circuit and adapted to force flow of a cryogen in the second circuit to and from the superconductive electric machine and being operable in a normal mode for maintaining the cryogen and thereby the superconductive electric machine at the normal operating temperature.

20 Claims, 1 Drawing Sheet

CRYOGENIC COOLING SYSTEM WITH COOLDOWN AND NORMAL MODES OF OPERATION

BACKGROUND OF INVENTION

This invention relates to refrigeration and, more particularly, to a cryogenic cooling system with cooldown and steady state or normal modes of operation for cooling a superconductive electric machine. As used herein, the term "cryogenic" is defined to describe a temperature generally colder than 150 Kelvin.

Superconducting devices include magnetic resonance imaging (MRI) systems for medical diagnosis, superconductive rotors for electric generators and motors, and magnetic levitation devices for train transportation. The superconductive coil assembly of the superconducting magnet for a superconductive device comprises one or more superconductive coils wound from superconductive wire and which may be generally surrounded by a thermal shield. The assembly is contained within a vacuum enclosure.

Some superconductive magnets are conductively cooled by a cryocooler coldhead (such as that of a conventional Gifford-McMahon cryocooler) which is mounted to the magnet. Mounting of the cryocooler coldhead to the magnet, however, creates difficulties including the detrimental effects of stray magnetic fields on the coldhead motor, vibration transmission from the coldhead to the magnet, and temperature gradients along the thermal connections between the coldhead and the magnet. Such conductive cooling is not generally suitable for cooling rotating magnets, such as may constitute a superconductive rotor.

Other superconductive magnets are cooled by liquid helium in direct contact with the magnet, with the liquid helium boiling off as gaseous helium during magnet cooling and with the gaseous helium typically escaping from the magnet to the atmosphere. Locating the containment for the liquid helium inside the vacuum enclosure of the magnet increases the size of the superconductive magnet system, which is undesirable in many applications.

What is needed are innovations in a cryogenic cooling system useful for cooling a superconductive device. Such cooling system must be remotely located from the magnet. Additionally, the cooling system should be capable of cooling a rotating superconductive magnet, such as that of an electric generator rotor.

One innovation directed to this need is disclosed in U.S. Pat. No. 5,513,498 to Ackermann et al. which is assigned to the intent assignee. This innovation employs a single compressor and a rotary valve for causing alternating circulation of a fluid cryogen, such as helium, in opposite directions in coolant circuits for cooling a superconductive device. While the innovation disclosed in the Ackermann et al. patent substantially overcomes the aforementioned problems, another innovation is still needed to meet the objectives of providing a cryogenic cooling system to cool down the rotor of a superconductive generator to an operating temperature and to maintain the rotor at that operating temperature for normal operation.

SUMMARY OF INVENTION

A cryogenic cooling system with cooldown and normal modes of operation is designed to achieve these two modes of operation with a forced flow helium cooling system that has both cooldown and normal modes of operation for cooling the superconductive coils of a rotating machine and for providing redundancy for improved system reliability.

In one embodiment of the invention, a cryogenic cooling system for a superconductive electric machine comprises means for defining a first circuit adapted to force flow of a cryogen to and from the superconductive electric machine and being operable in a cooldown mode for cooling the cryogen and thereby the superconductive electric machine to a normal operating temperature; and means for defining a second circuit adapted to force flow of a cryogen to and from the superconductive electric machine and being operable in a normal mode for maintaining the cryogen and thereby the superconductive electric machine at the normal operating temperature.

BRIEF DESCRIPTION OF DRAWINGS

The single FIGURE is a schematic diagram of a cryogenic cooling system in accordance with a preferred embodiment of the invention, coupled with a superconductive electric machine.

DETAILED DESCRIPTION

Figure 1:
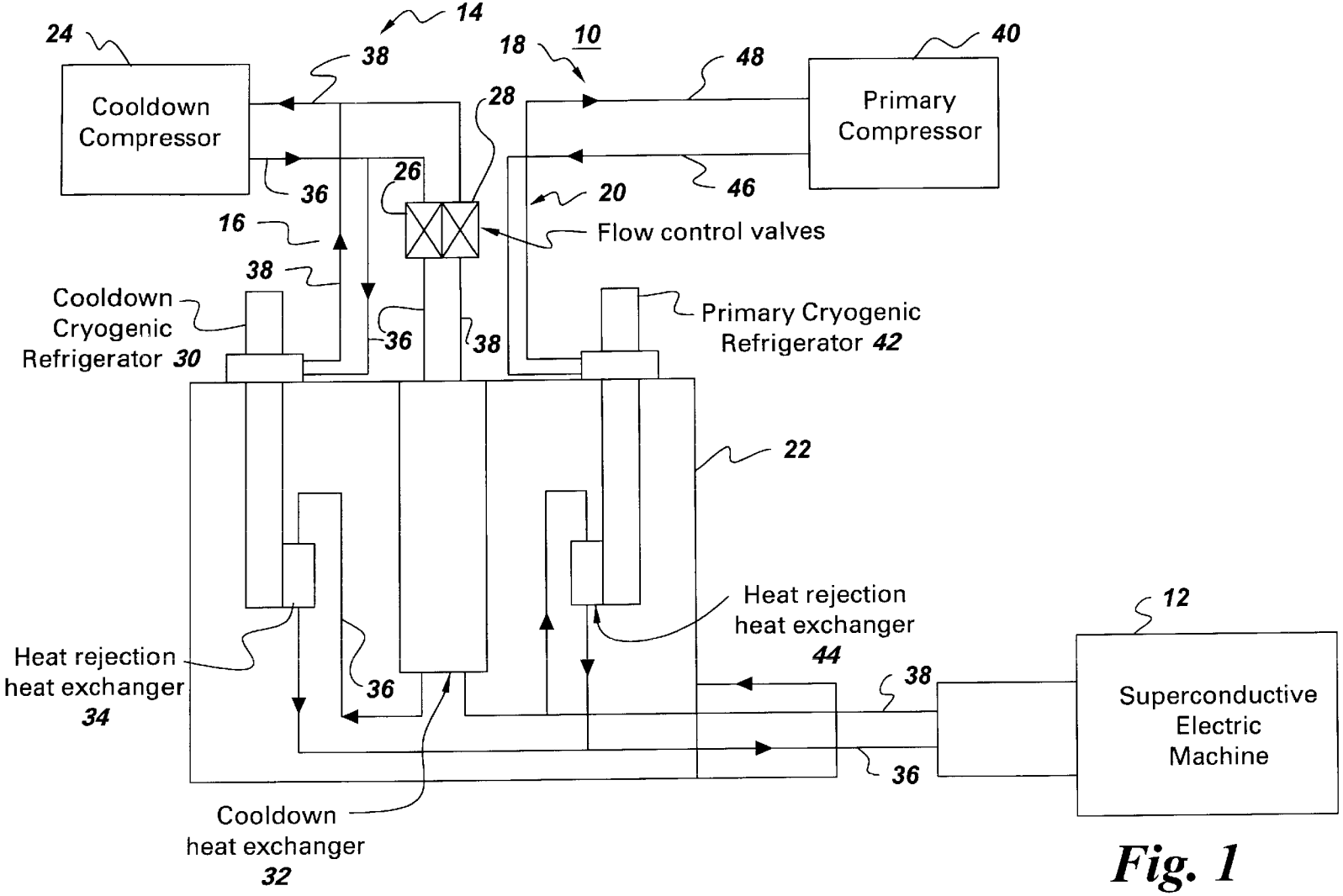

As shown in the FIGURE, a cryogenic cooling system 10 is coupled with a superconductive electric machine 12, such as a superconductive generator. Cooling system 10 includes a first set of components 14 provided in a first arrangement adapted to force a cryogen, such as helium, to flow in a first circuit 16 to and from superconductive electric machine 12 and a second set of components 18 provided in a second arrangement adapted to force a cryogen, such as helium, to flow in a second circuit 20 to and from the superconductive electric machine. The first set of components 14 are operable in a cooldown mode for cooling superconductive electric machine 12 to a normal operating temperature. The second set of components 18 are operable in a normal mode for maintaining the superconductive electric machine at the normal operating temperature.

Cryogenic cooling system 10 includes a cold box 22 housing some of the components of each of component sets 14 and 18. The first set of components 14 includes a cooldown compressor 24 and a pair of flow control valves 26, 28 located outside cold box 22, and a closed cycle cooldown cryogenic refrigerator 30, a cooldown heat exchanger 32, and a heat rejection heat exchanger 34 located inside cold box 22. The first set of components 14 also includes a first pair of cryogen feed and return lines 36 and 38, respectively, extending between cooldown compressor 24 and superconductive electric machine 12. Flow control valves 26, 28 are respectively connected in feed and return lines 36 and 38 from and to cooldown compressor 24. Cooldown cryogenic refrigerator 30 is connected to feed and return lines 36 and 38 from and to the cooldown compressor 24, respectively, in parallel with flow control valves 26 and 28. Cooldown heat exchanger 32 is connected in the feed and return lines 36 and 38 between flow control valves 26 and 28 and superconductive electric machine 12. Heat rejection heat exchanger 34 is coupled in a heat exchange relationship to cooldown cryogenic refrigerator 30 and is connected in feed line 36 between cooldown heat exchanger 32 and superconductive electric machine 12.

The second set of components 18 includes a primary compressor 40 located outside cold box 22 and a closed cycle primary cryogenic refrigerator 42 and heat rejection heat exchanger 44 located inside cold box 22. The second set of components 18 also includes a second pair of cryogen flow feed and return lines 46 and 48, respectively, extending from primary compressor 40. Primary cryogenic refrigerator 42 is connected in the feed and return lines 46 and 48, respectively, from and to primary compressor 40. Heat rejection heat exchanger 44 is coupled in a heat exchange relationship to primary cryogenic refrigerator 42 and connected in the feed and return lines 36 and 38, respectively, to and from superconductive electric machine 12 in parallel with the first set of components 14.

In operation, cooldown compressor 24 provides high pressure cryogen gas, such as helium, to operate cooldown cryogenic refrigerator 30 and to force flow of the gas via cooldown heat exchanger 32 and heat rejection heat exchanger 34 to and from the superconductive electric machine 12 for cooling the same. The two modes of operation of cooling system 10 are the cooldown mode and the steady state or normal operating mode.

During the cooldown mode, helium gas, extracted from cooldown compressor 24, is cooled by cooldown heat exchanger 32 and cooldown cryogenic refrigerator 30 and used to cool machine 12 from room temperature to its low operating temperature.

During the normal operating mode, cooldown refrigerator 30 and gas extracted from cooldown compressor 24 are shut down by selective operation of flow control valves 26 and 28, and cooling is then provided from only primary cryogenic refrigerator 42 and primary compressor 40. During this mode of operation, helium gas is circulated in a cooling loop between heat rejection heat exchanger 44 and machine 12 due to rotation of the rotor (not shown) of machine 12.

While only certain preferred features of the invention have been illustrated and described, many modifications and changes will occur to those skilled in the art. It is, therefore, to be understood that the appended claims are intended to cover all such modifications and changes as fall within the true spirit of the invention.

What is claimed is:

1. A cryogenic cooling system for use with a superconductive electric machine, comprising:

a first set of components arranged in a first circuit and adapted to force flow of a cryogen to and from a superconductive electric machine and operable in a cooldown mode for cooling the cryogen and thereby the superconductive electric machine down to a normal operating temperature; and a second set of components arranged in a second circuit and adapted to force flow of a cryogen to and from the superconductive electric machine and operable in a normal mode for maintaining the cryogen and thereby the superconductive electric machine at the normal operating temperature.

2. The system of claim 1 in which said first circuit includes a cooldown compressor and cryogen flow feed and return lines between said cooldown compressor and the superconductive electric machine.

3. The system of claim 2 in which said first circuit further includes flow control valves respectively connected in said feed and return lines from and to said cooldown compressor.

4. The system of claim 3 in which said first circuit further includes a cooldown cryogenic refrigerator connected in said feed and return lines from and to said cooldown compressor in parallel with said flow control valves.

5. The system of claim 4 in which said first circuit further includes a cooldown heat exchanger connected in said feed and return lines between said flow control valves and the superconductive electric machine.

6. The system of claim 5 in which said first circuit further includes a heat rejection heat exchanger coupled in a heat exchange relationship to said cooldown cryogenic refrigerator and connected in said feed line between said cooldown heat exchanger and the superconductive electric machine.

7. The system of claim 6 further comprising:

a cold box, said cooldown cryogenic refrigerator, heat rejection heat exchanger and cooldown heat exchanger being disposed inside of said cold box and, said cooldown compressor and flow control valves being disposed outside of said cold box.

8. The system of claim 1 in which said second circuit includes a primary compressor and a pair of cryogen flow feed and return lines between said primary compressor and the superconductive electric machine.

9. The system of claim 8 in which said second circuit further includes a primary cryogenic refrigerator connected in said feed and return lines from and to said primary compressor.

10. The system of claim 9 in which said second circuit further includes a heat rejection heat exchanger connected to a second pair of cryogen flow feed and return lines to and from the superconductive electric machine.

11. The system of claim 10 further comprising:

a cold box, said primary cryogenic refrigerator and heat rejection heat exchanger being disposed inside of said cold box, and said primary compressor being disposed outside of said cold box.

12. A cryogenic cooling system for use with a superconductive electric machine, comprising:

a first set of components arranged in a first circuit and adapted to force flow of a cryogen in said first circuit to and from said superconductive electric machine and operable in a cooldown mode for cooling the cryogen and thereby the superconductive electric machine down to a normal operating temperature;

a second set of components arranged in a second circuit and adapted to force flow of a cryogen in said second circuit to and from the superconductive electric machine and operable in a normal mode for maintaining the cryogen and thereby the superconductive electric machine at the normal operating temperature; and a cold box containing a portion of said components of said first and second sets the remainder of said components of said first and second sets being disposed outside of said cold box.

13. The system of claim 12 in which said first circuit includes a cooldown compressor and cryogen flow feed and return lines between said cooldown compressor and the superconductive electric machine.

14. The system of claim 13 in which said first circuit further includes flow control valves respectively connected in said feed and return lines from and to said cooldown compressor.

15. The system of claim 14 in which said first circuit further includes a cooldown cryogenic refrigerator connected in said feed and return lines from and to said cooldown compressor in parallel with said flow control valves.

16. The system of claim 15 in which said first circuit further includes a cooldown heat exchanger connected in said feed and return lines between said flow control valves and the superconductive electric machine.

17. The system of claim 16 in which said first circuit further includes a heat rejection heat exchanger coupled in a heat exchange relationship to said cooldown cryogenic refrigerator and connected in said feed line between said cooldown heat exchanger and the superconductive electric machine.

18. The system of claim 12 in which said second circuit includes a primary compressor and a pair of cryogen flow feed and return lines between said primary compressor and the superconductive electric machine.

19. The system of claim 18 in which said second circuit further includes a primary cryogenic refrigerator connected in said feed and return lines from and to said primary compressor.

20. The system of claim 19 in which said second circuit further includes a heat rejection heat exchanger connected in a second pair of said feed and return lines to and from the superconductive electric machine.

* * * * *